US008547392B2

(12) United States Patent
Park et al.

(10) Patent No.: US 8,547,392 B2
(45) Date of Patent: Oct. 1, 2013

(54) APPARATUS AND METHOD FOR ACHROMATIC AND CHROMATIC COLOR CONVERSION

(75) Inventors: Bongim Park, Asan-si (KR); Kang-Hyun Kim, Seoul (KR); Jae-Won Jeong, Seoul (KR); Woo-Young Lee, Daegu (KR)

(73) Assignee: Samsung Display Co., Ltd., Yongin (KR)

( * ) Notice: Subject to any disclaimer, the term of this patent is extended or adjusted under 35 U.S.C. 154(b) by 424 days.

(21) Appl. No.: 12/984,109

(22) Filed: Jan. 4, 2011

(65) Prior Publication Data

US 2011/0169856 A1 Jul. 14, 2011

(30) Foreign Application Priority Data

Jan. 8, 2010 (KR) ..... 10-2010-0001756

(51) Int. Cl.
*G09G 5/02* (2006.01)

(52) U.S. Cl.
USPC ..... 345/601; 345/589

(58) Field of Classification Search
None
See application file for complete search history.

(56) References Cited

U.S. PATENT DOCUMENTS

| | | | | |
|---|---|---|---|---|
| 6,894,697 | B2 * | 5/2005 | Matsuda | 345/589 |
| 2006/0214945 | A1 * | 9/2006 | Nitta et al. | 345/603 |
| 2007/0285679 | A1 * | 12/2007 | Umezawa | 358/1.2 |
| 2008/0074717 | A1 * | 3/2008 | Blonde et al. | 358/520 |
| 2009/0225105 | A1 * | 9/2009 | Park et al. | 345/690 |

FOREIGN PATENT DOCUMENTS

| | | |
|---|---|---|
| JP | 2005-249821 | 9/2005 |
| KR | 1020080051598 | 6/2008 |
| KR | 1020080072389 | 8/2008 |

OTHER PUBLICATIONS

Beom Park et al. Pixel-Division Technology for High-Quality Vertical-Alignment LCDs; IEEE Electron Device Letters, vol. 31, No. 9, Sep. 2010.*

Sang Soo Kim et al. New technologies for advanced LCD-TV performance; Journal of the SID, Dec. 4, 2004.*

Sun et al. Study on the 3D Interpolation Models Used in Color Conversion; IACSIT International Journal of Engineering and Technology, vol. 4, No. 1, Feb. 2012.*

* cited by examiner

*Primary Examiner* — Carlos Perromat
(74) *Attorney, Agent, or Firm* — H.C. Park & Associates, PLC

(57) ABSTRACT

A signal processing apparatus and a signal processing method are disclosed. The signal processing apparatus includes a correction block and a division correction block. The correction block receives grayscale data comprising achromatic color grayscale data or chromatic color grayscale data to create corrected grayscale data. The division correction block receives the corrected grayscale data to create first division grayscale data and second division grayscale data having a grayscale value less than or equal to a grayscale value of the first division grayscale data. The correction block includes a first correction block and a second correction block. The first correction block receives the grayscale data and includes a one-dimensional lookup table to create corrected create achromatic color grayscale data. The second correction block includes a three-dimensional lookup table and an interpolator.

22 Claims, 8 Drawing Sheets

APPARATUS AND METHOD FOR ACHROMATIC AND CHROMATIC COLOR CONVERSION

CROSS-REFERENCE TO RELATED APPLICATION

This application claims priority from and the benefit of Korean Patent Application No. 10-2010-0001756, filed on Jan. 8, 2010, which is hereby incorporated by reference for all purposes as if fully set forth herein.

BACKGROUND OF THE INVENTION

1. Field of the Invention

Exemplary embodiments of the present invention relate to a signal processing apparatus and a signal processing method. More particularly, exemplary embodiments of the present invention relate to a signal processing apparatus and a signal processing method that can be used in a display apparatus.

2. Description of the Background

Conventionally, a liquid crystal display (LCD) is typically used in restricted fields such as the display of simple characters or numbers in a calculator, or a black and white display in a cellular phone or a small-size game machine. However, since the LCD has advantages of being thin and light weight with low power consumption, the LCD is extensively used in various fields. Particularly, since the LCD is used in display fields (e.g., a color monitor, a lap-top computer, and a large-scale TV) requiring high image quality, high-quality colors must be realized in the LCD.

Generally, the LCD includes an LCD panel having liquid crystals, and adjusts the transmittance of light irradiated from a rear surface of the LCD panel by changing an electric field applied to the liquid crystals. To this end, the LCD may include two transparent substrates, on which a thin film transistor, a pixel electrode, a color filter, and a common electrode are provided, liquid crystals interposed between the two transparent substrates, a backlight to irradiate light to the LCD panel, and a controller to control the driving of the LCD panel and backlight.

In order to realize high-quality colors in the LCD, color filter characteristics may be changed, different light sources may be used in the backlight, and corrected color signals may be applied to pixels of the LCD panel.

SUMMARY OF THE INVENTION

Exemplary embodiments of the prevent invention provide a signal processing apparatus and a signal processing method that may process signals in real time while reducing consumption of memory capacity due to less computation.

Additional features of the invention will be set forth in the description which follows, and in part will be apparent from the description, or may be learned by practice of the invention.

Exemplary embodiments of the present invention disclose a signal processing apparatus including a correction block and a division correction block. The correction block receives grayscale data comprising achromatic color grayscale data or chromatic color grayscale data to create corrected grayscale data. The division correction block receives the corrected grayscale data to create first division grayscale data and second division grayscale data having a grayscale value less than or equal to a grayscale value of the first division grayscale data. The correction block includes a first correction block and a second correction block. The first correction block receives the grayscale data and includes a one-dimensional lookup table to create corrected achromatic color grayscale data based on the achromatic color grayscale data. The second correction block includes a three-dimensional lookup table, which stores a portion of the chromatic color grayscale data, and an interpolator, which corrects, through an interpolation scheme, a remaining portion of the chromatic color grayscale data by considering the corrected achromatic color grayscale data to create corrected chromatic color grayscale data through the three-dimensional lookup table and the interpolator.

Exemplary embodiments of the present invention also disclose a signal processing method as follows. External grayscale data including at least red, green, and blue grayscale data are received. Achromatic color grayscale data are created based on one of the red, green, and blue grayscale data of the external grayscale data. Corrected achromatic color grayscale data are created by using a one-dimensional lookup table based on the achromatic color grayscale data. Corrected chromatic color grayscale data are created by using a three-dimensional lookup table to store a portion of the chromatic color grayscale data and an interpolator to correct, through an interpolation scheme, a remaining portion of the chromatic color grayscale data by considering the corrected achromatic color grayscale data. The corrected achromatic color grayscale data or the corrected chromatic color grayscale data are received, and first division grayscale data and second division grayscale data having a grayscale value less than or equal to a grayscale value of the first division grayscale data are created.

In the creating of the corrected chromatic color grayscale data, the interpolator utilizes sub-domains formed by adjacent points among points "a", "b", "c", and "d", which are defined by Equation 1, a point "e" corresponding to the corrected achromatic color grayscale data, a point "ab" positioned on a line linking the point "a" with the point "b" while corresponding to the point "e", a point "ac" positioned on a line liking the point "a" with the point "c" while corresponding to the point "e", a point "bd" positioned on a line liking the point "b" with the point "d" while corresponding to the point "e", and a point "cd" positioned on a line linking the point "c" with the point "d" while corresponding to the point "e" in a first color coordinate space formed by red, blue, and green grayscale axes. The grayscale data are corrected through bilinear interpolation based on vertexes of a sub-domain comprising the grayscale data among the sub-domains.

$$a = f_{000} + (f_{001} - f_{000})\frac{z}{N}$$
$$b = f_{100} + (f_{101} - f_{100})\frac{z}{N}$$
$$c = f_{010} + (f_{011} - f_{010})\frac{z}{N}$$
$$d = f_{110} + (f_{111} - f_{110})\frac{z}{N}$$

Equation 1 where $f_{000}$ to $f_{111}$ represent color coordinates corresponding to the chromatic color grayscale data stored in the three-dimensional lookup table while surrounding the grayscale data in the first color coordinate space comprising the red, blue, and green grayscale axes, the "z" represents a distance between $f_{000}$ and a point corresponding to one of the red, green, and blue grayscale data of the grayscale data, and the "N" represents a distance from $f_{000}$ to $f_{001}$.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DESCRIPTION OF THE ILLUSTRATED EMBODIMENTS

Figure 1:
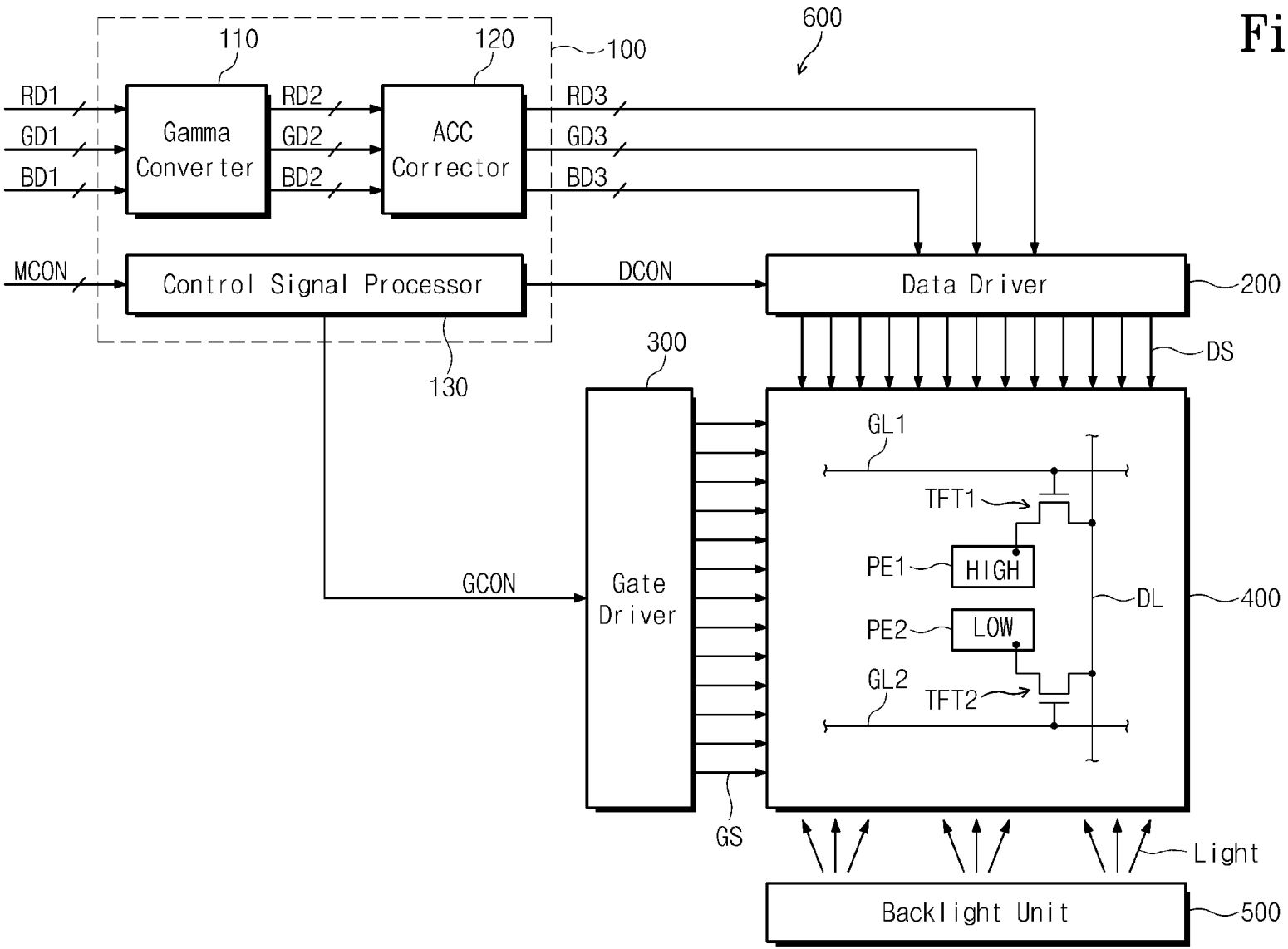
FIG. 1 is a plan view schematically showing a display apparatus according to a first exemplary embodiment of the present invention.

Exemplary embodiments of the present invention are described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

FIG. 1 is a plan view schematically showing a display apparatus 600 according to a first exemplary embodiment of the present invention.

Referring to FIG. 1, the display apparatus 600 includes a timing controller 100, a data driver 200, a gate driver 300, a display panel 400, and a backlight unit 500.

The timing controller 100 receives red, blue, and green image signals RD1, BD1, and GD1, and a main control signal MCON from an external graphics controller (not shown). The timing controller 100 performs accurate color capture (ACC) correction with respect to the red, green, and blue image signals RD1, GD1, and BD1 to output red, green, blue driving signals RD3, GD3, and BD3. The timing controller 100 also outputs a data control signal DCON and a gate control signal GCON in response to the main control signal MCON. Details of the timing controller 100 are described in more detail below.

The data driver 200 receives the data control signal DCON from the timing controller 100 to output data signals DS to the display panel 400.

The gate driver 300 receives the gate control signal GCON from the timing controller 100 to output gate signals GS to the display panel 400.

The display panel 400 receives the data signals DS and the gate signals GS from the data driver 200 and the gate driver 300, respectively, to display an image according to the data and gate signals DS and GS.

The display panel 400 may have various configurations that are sufficient to display an image. According to one exemplary embodiment of the present invention, the display panel 400 may include a liquid crystal display (LCD) panel (not shown). The LCD panel typically includes a first substrate including a plurality of pixels, a second substrate opposite the first substrate, and a liquid crystal layer interposed between the first substrate and the second substrate.

Although not shown, according to one exemplary embodiment, the first substrate may include a thin film transistor (TFT) and a pixel electrode for each pixel, and the second substrate may include a color filter and a common electrode. The TFT is connected to the data driver 200 and the gate driver 300. The TFT receives the data signals DS from the data driver 200 and the gate signals GS from the gate driver 300 to apply a data signal (e.g., a voltage) to the pixel electrode. The common electrode forms an electric field with the pixel electrode into which the voltage has been applied. This electric field drives the liquid crystal layer between the first and second substrates to display an image.

In this case, according to one exemplary embodiment, the display panel 400 may have a super patterned vertical alignment (S-PVA) structure, in which each pixel may be controlled by two gate lines and one data line. According to the S-PVA structure, the pixel electrode of each pixel includes a first sub pixel electrode PE1 and a second sub pixel electrode PE2 to receive voltages different from each other based on a patterned vertical alignment (PVA) structure. Thus, the first sub pixel electrode PE1 receives a first voltage, the second sub pixel electrode PE2 receives a second voltage, and the magnitude of the second voltage is less than the magnitude of the first voltage.

Hereinafter, the S-PVA structure will be described in more detail. A first opening (not shown) is patterned in the pixel electrode of the first substrate, and a second opening (not shown) is patterned in the common electrode of the second substrate. The second opening corresponds to the first opening.

Meanwhile, according to an exemplary embodiment of the present invention, each pixel can be controlled by two gate lines and one data line. In other words, as shown in FIG. 1, one unit pixel can be controlled by two gate lines GL1 and GL2 and one data line DL. This structure may be called a "2GID" structure.

Hereinafter, the 2GID structure will be described in more detail. On the first substrate, the first and second gate lines GL1 and GL2 are parallel to each other, and the data line DL crosses the first and second gate lines GL1 and GL2 in a direction that is substantially perpendicular to the first and second gate lines GL1 and GL2. A first thin film transistor TFT1 is electrically connected to the data line DL, the first gate line GL1, and the first sub pixel electrode PE1, and a second thin film transistor TFT2 is electrically connected to the data line DL, the second gate line GL2, and the second sub pixel electrode PE2.

A backlight unit 500 is provided behind, or at a side of, the display panel 400 to supply light to the display panel 400. The backlight unit 500 includes a light source (not shown) to generate and provide light to the display panel 400.

For example, the timing controller 100 includes a gamma converter 110, an ACC corrector 120, and a control signal processor 130.

The gamma converter 110 receives RGB image signals from the external graphics controller to output RGB intermediate signals. In other words, the gamma converter 110 corrects the received red, green, and blue image signals RD1, GD1, and BD1 according to red, green, and blue gamma curves, respectively, to output red, green, and blue intermediate signals RD2, GD2, and BD2.

The ACC corrector 120 compensates color signals to be applied to pixels of the LCD panel so that the color signals may be close to desired colors. The ACC correction is to reduce or remove the shift of color characteristics according to grayscales such that color balance can be maintained according to the grayscales.

The ACC corrector 120 receives the red, green, and blue intermediate signals RD2, GD2, and BD2 from the gamma converter 110 and performs the ACC correction to output grayscale data. For example, the ACC corrector 120 may ACC correct the red, green, and blue intermediate signals RD2, GD2, and BD2 to output the red, green, blue driving signals RD3, GD3, and BD3.

The ACC corrector 120 may include an achromatic color correction block and a chromatic color correction block to separately perform the ACC correction with respect to achromatic and chromatic colors. A more detailed description of the ACC correction is made below with reference to accompanying drawings.

The control signal processor 130 receives the main control signal MCON from the external graphics controller (not shown), and outputs the data control signal DCON and the gate control signal GCON in response to the main control signal MCON. Although not shown in drawings, the control signal processor 130 may control the gamma converter 110 and the ACC corrector 120.

Figure 2:
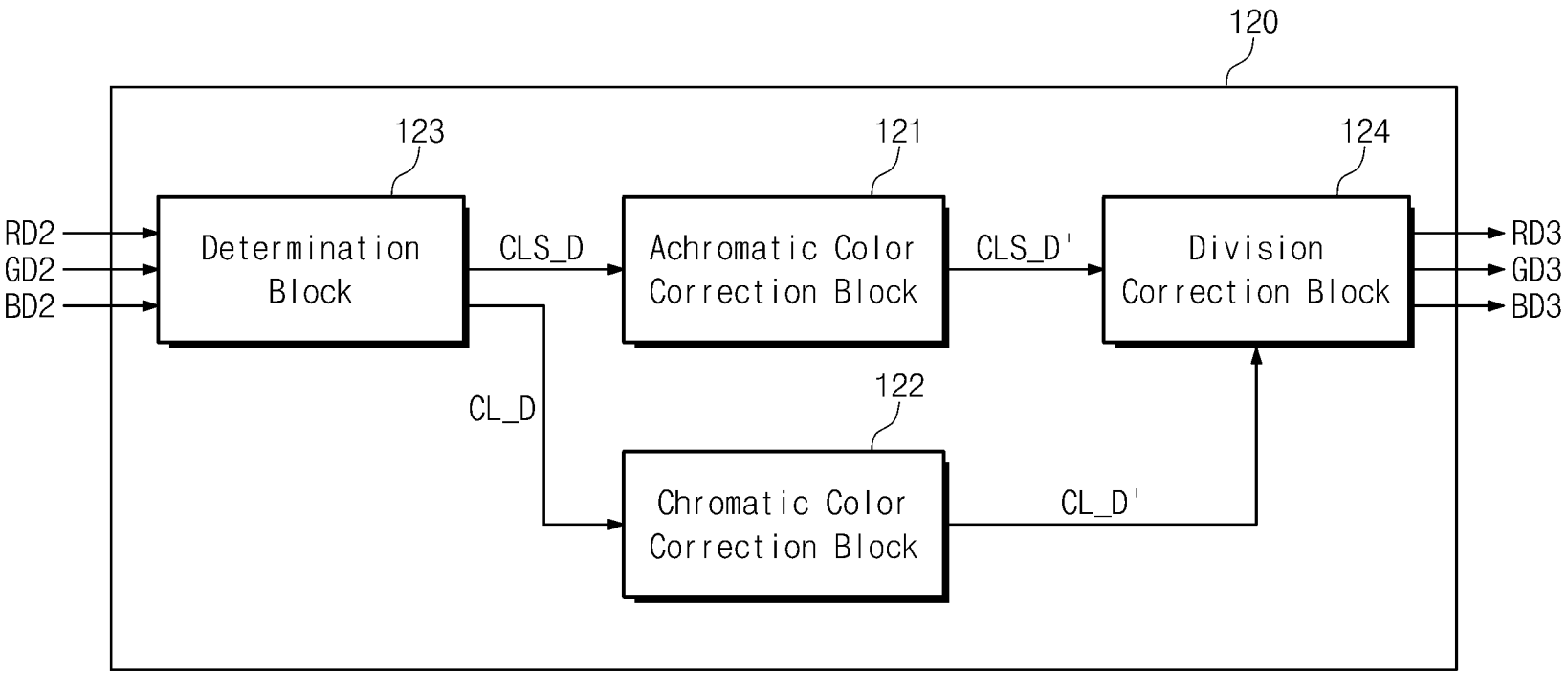
FIG. 2 is a view schematically showing an accurate color capture (ACC) corrector of the display apparatus according to the first exemplary embodiment of the present invention.

FIG. 2 is a view schematically showing the ACC corrector 120 of the display apparatus according to the first exemplary embodiment of the present invention.

Referring to FIG. 2, the ACC corrector 120 includes a determination block 123, an achromatic color correction block 121, a chromatic color correction block 122, and a division correction block 124.

The determination block 123 receives grayscale data, that is, the red, green, and blue intermediate signals RD2, GD2, and BD2 from the gamma converter 110, to determine if the grayscale data are achromatic color grayscale data CLS_D or chromatic color grayscale data CL_D. If all of the red, green, and blue intermediate signals RD2, GD2, and BD2 have the same grayscale value, the determination block 123 recognizes the grayscale data as achromatic color grayscale data CLS_D and provides the achromatic color grayscale data CLS_D to the achromatic color correction block 121. But if at least one of the red, green, and blue intermediate signals RD2, GD2, and BD2 has a different grayscale value than the others, the determination block 123 recognizes the grayscale data as chromatic color grayscale data CL_D and provides the chromatic color grayscale data CL_D to the chromatic color correction block 122.

The achromatic color correction block 121 and the chromatic color correction block 122 are arranged in parallel. Accordingly, the grayscale data are corrected through either the achromatic color correction block 121 or the chromatic color correction block 122. In other words, grayscale data are not corrected through both of the achromatic color correction block 121 and the chromatic color correction block 122.

The achromatic color correction block 121 and the chromatic color correction block 122 are used to correct the grayscale data input from the gamma converter 110 to make signals closest to desired colors. When grayscale data are directly applied to pixels corresponding to red, green, and blue colors without correction, even if a constant gray-scale voltage is applied to the liquid crystal layer, a difference may be made in light transmittance of the liquid crystal layer between the colors. Accordingly, desired colors may not be exactly expressed. After correcting the grayscale data in consideration of the difference made in the light transmittance between colors, the achromatic color correction block 121 and the chromatic color correction block 122 apply corrected grayscale data to the pixels corresponding to the red, green, and blue colors. Therefore, colors close to desired colors may be expressed.

The achromatic color correction block 121 may include a lookup table (LUT) and receives the achromatic color grayscale data CLS_D to create corrected achromatic color grayscale data CLS_D'. In the achromatic color grayscale data CLS_D, all of the red, green, and blue intermediate signals RD2, GD2, and BD2 have the same grayscale value, so that the LUT can be formed in one dimension (1-D). For example, the 1-D LUT may have a format shown in Table 1 below. Referring to Table 1, when an input grayscale value is 7, data values are corrected based on the LUT such that the red, green, and blue pixels have grayscale values of 7, 9, and 6, respectively.

TABLE 1

| Input grayscale | Grayscale value of red pixel | Grayscale value of green pixel | Grayscale value of blue pixel |
|---|---|---|---|
| 0 | 0 | 0 | 0 |
| 1 | 1 | 1 | 1 |
| 2 | 2 | 3 | 2 |
| 3 | 4 | 5 | 4 |
| 4 | 5 | 6 | 5 |
| 5 | 6 | 7 | 6 |
| 6 | 6 | 8 | 6 |
| 7 | 7 | 9 | 6 |
| 8 | 7 | 9 | 7 |
| 9 | 8 | 10 | 7 |
| 10 | 8 | 10 | 8 |
| 11 | 9 | 11 | 8 |
| 12 | 9 | 11 | 9 |
| 13 | 10 | 12 | 9 |
| 14 | 10 | 12 | 10 |
| 15 | 10 | 13 | 10 |
| 16 | 11 | 14 | 10 |
| 17 | 11 | 14 | 11 |
| 18 | 12 | 15 | 11 |
| 19 | 12 | 16 | 12 |
| 20 | 12 | 16 | 13 |
| 21 | 13 | 17 | 13 |
| 22 | 13 | 18 | 13 |
| 23 | 14 | 19 | 14 |
| 24 | 15 | 20 | 15 |
| ... | ... | ... | ... |
| 246 | 248 | 248 | 236 |
| 247 | 249 | 249 | 238 |
| 248 | 250 | 249 | 239 |
| 249 | 251 | 250 | 242 |
| 250 | 251 | 251 | 244 |
| 251 | 252 | 252 | 246 |

TABLE 1-continued

| Input grayscale | Grayscale value of red pixel | Grayscale value of green pixel | Grayscale value of blue pixel |
|---|---|---|---|
| 252 | 253 | 253 | 248 |
| 253 | 254 | 254 | 254 |
| 254 | 254 | 254 | 254 |
| 255 | 255 | 255 | 255 |

The chromatic color correction block 122 includes a 3-D LUT for each of red, green, and blue colors.

Figure 3:
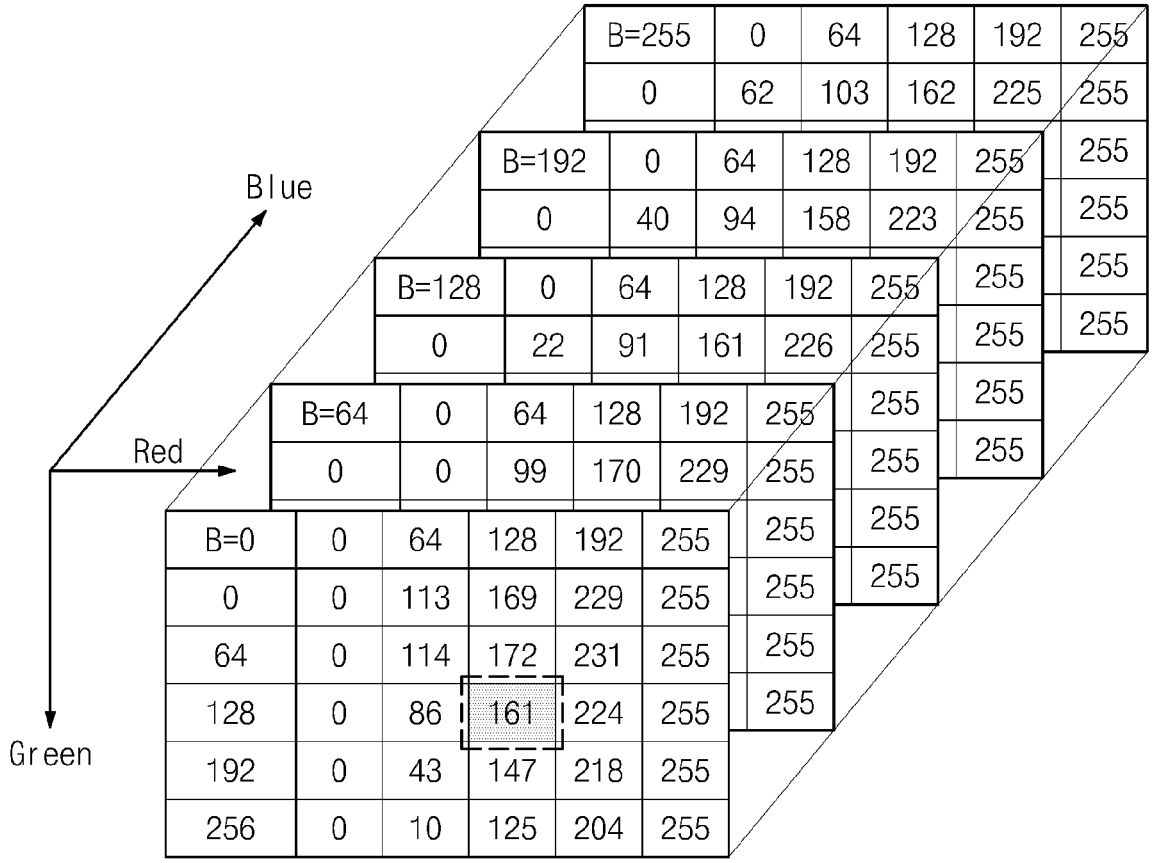
FIG. 3 is a view showing a 3-D lookup table (LUT) according to an exemplary embodiment of the present invention.

FIG. 3 is a view showing a 3-D LUT according to one exemplary embodiment of the present invention, which shows a 5×5×5 3-D LUT. Although a 5×5×5 LUT is shown in FIG. 3, the LUT may have various sizes according to memory capacity. For example, the LUT may be a 9×9×9 LUT.

The chromatic color correction block 122 may include a 3-D LUT (not shown) to store only a portion of the whole expressible chromatic color grayscale data CL_D and an interpolator to correct the chromatic color grayscale data CL_D that are not stored in the 3-D LUT, through an interpolation scheme. The chromatic color correction block 122 receives the chromatic color grayscale data CL_D to create corrected chromatic color grayscale data CL_D' through the 3-D LUT and, if necessary, the interpolator.

Referring to FIG. 3, in order to express a color of an original image, in the case of a chromatic color where red, green, and blue pixels have grayscale values of 128, 128, and 0, respectively, a corrected grayscale value of the red pixel becomes 161. In the case of a chromatic color where red, green, and blue pixels have grayscale values of 192, 0, and 128, respectively, a corrected grayscale value of the red pixel becomes 226.

The interpolator corrects chromatic color grayscale data CL_D, which are not stored in the 3-D LUT, through an interpolation scheme. The interpolation scheme may be, for example, a trilinear interpolation scheme.

Figure 4:
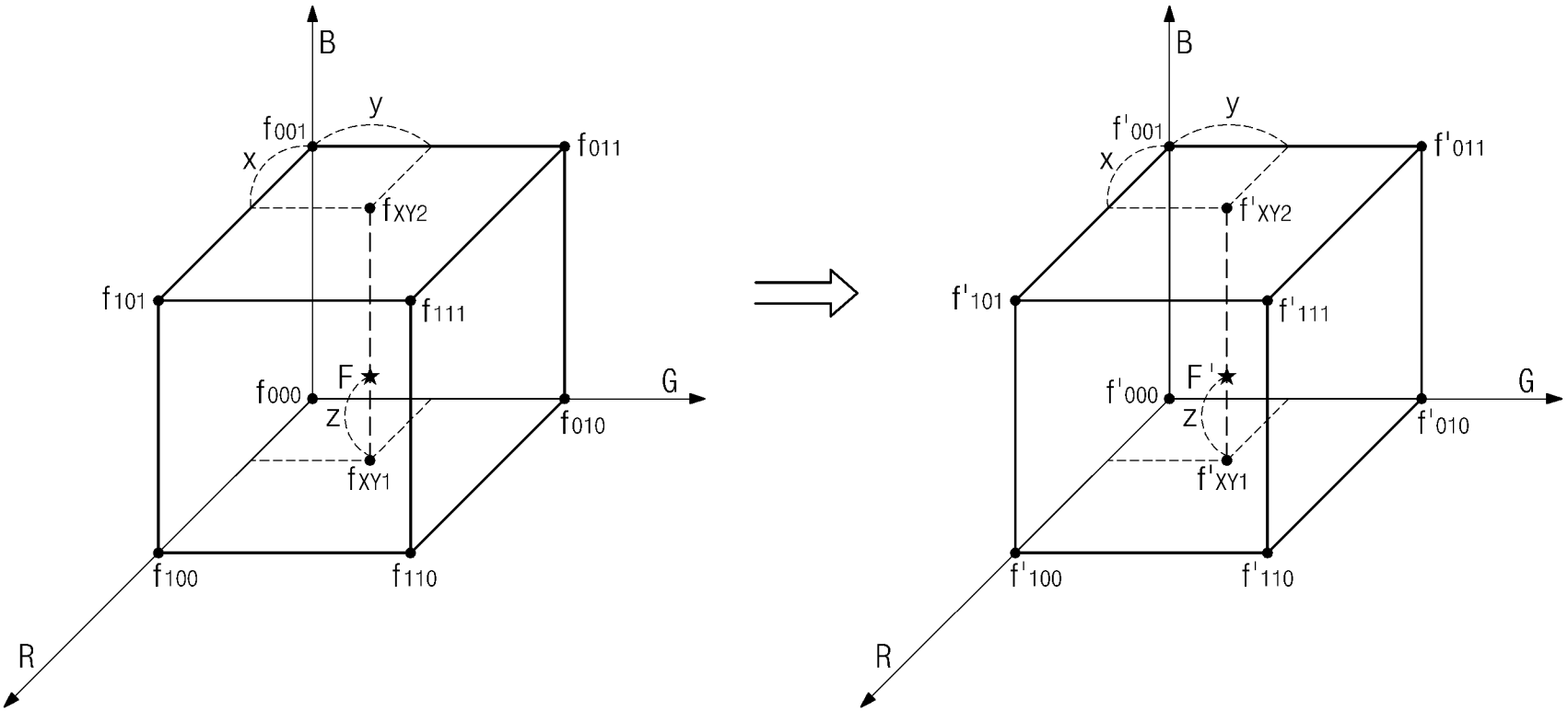
FIG. 4 is a view showing coordinates set by three axes of red grayscale data, green grayscale data, and blue grayscale data, respectively, and are perpendicular to each other in order to explain a trilinear interpolation scheme.

FIG. 4 is a view showing coordinates set by three axes of red grayscale data, green grayscale data, and blue grayscale data, respectively. The three axes are perpendicular to each other in order to explain the trilinear interpolation scheme.

The trilinear interpolation scheme will be described in detail below with respect to FIG. 4.

Although various trilinear interpolation schemes exist, FIG. 4 shows only one trilinear interpolation scheme. Those skilled in the art understand that various trilinear interpolation schemes can be adapted to the present invention.

As shown in FIG. 4, $f_{000}$, $f_{001}$, $f_{010}$, $f_{011}$, $f_{100}$, $f_{101}$, $f_{110}$, and $f_{111}$ represent grayscale values of 8 neighboring pixels which serve as reference and surround a grayscale value F to be corrected.

For example, if grayscale values of red, green, and blue pixels to be corrected are 33, 35, and 38, $f_{000}$, $f_{001}$, $f_{010}$, $f_{011}$, $f_{100}$, $f_{101}$, $f_{110}$, and $f_{111}$ representing grayscale values of 8 neighboring pixels, which serve as reference and surround the grayscale value F, are (0, 0, 0), (0, 0, 64), (0, 64, 0), (0, 64, 64), (64, 0, 0), (64, 0, 64), (64, 64, 0), and (64, 64, 64). In addition, as shown in FIG. 4, $f'_{000}$, $f'_{001}$, $f'_{010}$, $f'_{011}$, $f'_{100}$, $f'_{101}$, $f'_{110}$, and $f'_{111}$ represent grayscale values of 8 neighboring pixels, which serve as reference and surround a corrected gray scale value F'. In other words, $f'_{000}$, $f'_{001}$, $f'_{010}$, $f'_{011}$, $f'_{100}$, $f'_{101}$, $f'_{110}$, and $f'_{111}$ represent corrected values of (0, 0, 0), (0, 0, 64), (0, 64, 0), (0, 64, 64), (64, 0, 0), (64, 0, 64), (64, 64, 0), and (64, 64, 64).

Values, x, y, and z are distances from the grayscale value F to be corrected between one among the grayscale values of the 8 neighboring pixels, which serve as reference and surround the grayscale value F, on an RG plane, a GB plane, and a BR plane. In detail, if grayscale values of the red, green, and blue pixels are 33, 35, and 38, the distances x, y, and z from one among the grayscale values of the 8 neighboring pixels, which serve as reference and surround the grayscale value F, for example, from the $f_{000}$ representing (0, 0, 0) are 32, 35, and 38.

In order to find the final corrected value F', a corrected value $f'_{xy1}$ of a point $f_{xy1}$, which is obtained by projecting the grayscale value F to be corrected onto a plane formed by $f_{000}$, $f_{100}$, $f_{110}$, and $f_{010}$, may be calculated. In addition, a corrected point $f'_{xy2}$ of a point $f_{xy2}$, which is obtained by projecting the grayscale value F onto a plane formed by $f_{001}$, $f_{101}$, $f_{011}$, and $f_{111}$ facing the point $f_{xy1}$, may be calculated.

The points $f'_{xy1}$ and $f'_{xy2}$ may be calculated by Equation 1 and Equation 2, respectively.

$$f'_{xy1} = f'_{000} + a_1\frac{x}{N} + b_1\frac{y}{N} + c_1\frac{xy}{N^2} \quad \text{Equation 1}$$

$$f'_{xy2} = f'_{000} + a_2\frac{x}{N} + b_2\frac{y}{N} + c_2\frac{xy}{N^2} \quad \text{Equation 2}$$

where N represents a grayscale interval according to the size of the LUT. For example, in the case of a 5×5×5 LUT as shown in FIG. 3, N equals 64. Parameters a1, b1, and c1, and a2, b2, and c2 may be obtained through Equations 3 and 4, respectively.

$$a_1 = f_{100}' - f_{000}'$$

$$b_1 = f_{010}' - f_{000}'$$

$$c_1 = f_{000}' + f_{110}' - f_{010}' - f_{100}' \quad \text{Equation 3}$$

$$a_2 = f_{101}' - f_{001}'$$

$$b_2 = f_{011}' - f_{001}'$$

$$c_2 = f_{001}' + f_{111}' - f_{011}' - f_{101}' \quad \text{Equation 4}$$

The corrected grayscale value F', which can be obtained from $f'_{xy1}$ and $f'_{xy2}$, may be calculated using Equation 5.

$$F' = f'_{000} + a\frac{x}{N} + b\frac{y}{N} + c\frac{z}{N} + d\frac{xy}{N^2} + e\frac{yz}{N^2} + f\frac{xz}{N^2} + g\frac{xyz}{N^3} \quad \text{Equation 5}$$

In Equation 5, parameters a, b, c, d, e, f, and g can be calculated using Equation 6.

$$a = f_{100}' - f_{000}'$$

$$b = f_{010}' - f_{000}'$$

$$c = f_{001}' - f_{000}'$$

$$d = f_{000}' + f_{110}' - f_{010}' - f_{100}'$$

$$e = f_{000}' + f_{011}' - f_{010}' - f_{001}'$$

$$f = f_{000}' + f_{101}' - f_{001}' - f_{100}'$$

$$g = f_{001}' + f_{010}' + f_{100}' + f_{111}' - f_{000}' - f_{011}' - f_{101}' - f_{110}' \quad \text{Equation 6}$$

Figure 5:
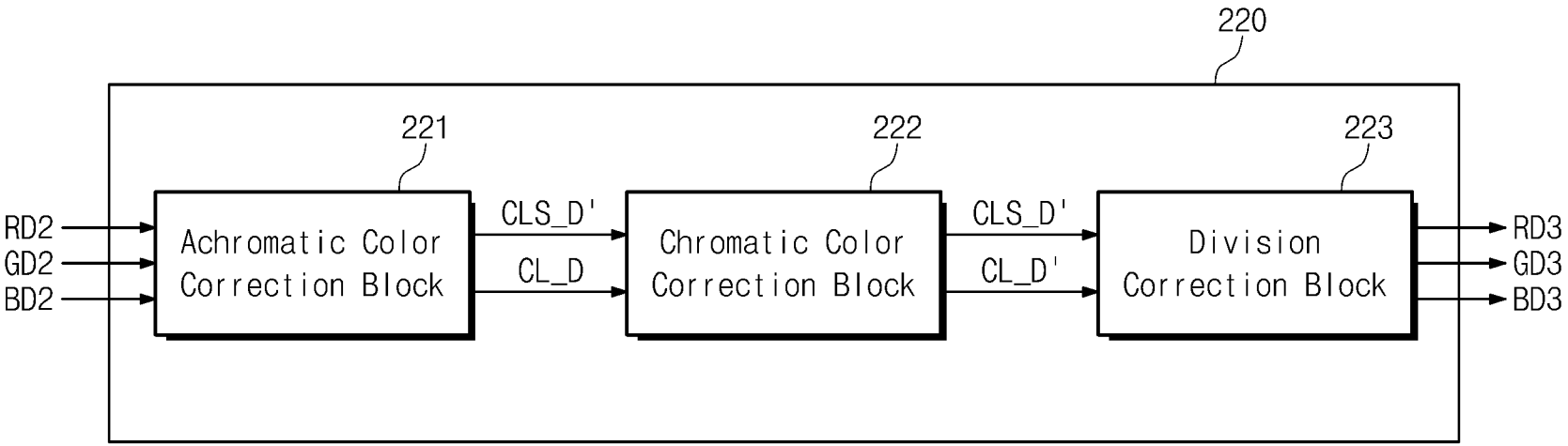
FIG. 5 is a block diagram schematically showing an ACC corrector in a display apparatus according to a second exemplary embodiment of the present invention.

The division correction block 124 receives the corrected achromatic color grayscale data CLS_D' from the achromatic color correction block 121 or receives the corrected chromatic color grayscale data CL_D' from the chromatic color correction block 122. The division correction block 124 divides the corrected achromatic color grayscale data CLS_D' or the corrected chromatic color grayscale data CL_D' to output the red, green, and blue driving signals RD3, GD3, and BD3. In addition, each of the red, green, and blue driving signals RD3, GD3, and BD3 may include first division grayscale data and second division grayscale data having a grayscale value less than or equal to a grayscale value of the first division grayscale data. In the present exemplary embodiment, the first division grayscale data may correspond to the first voltage applied to the first sub pixel electrode PE1 of each pixel, and the gray division grayscale data may correspond to the second voltage applied to the second sub pixel electrode PE2 of each pixel FIG. 5 is a block diagram schematically showing an ACC corrector 220 in a display apparatus according to a second exemplary embodiment of the present invention. The second exemplary embodiment will be described below while focusing on the difference between the first exemplary embodiment and the second exemplary embodiment in order to avoid redundancy, and the same reference numerals will be designated to the same elements.

According to the second exemplary embodiment of the present invention, the ACC corrector 220 includes an achromatic color correction block 221, a chromatic color correction block 222, and a division correction block 223.

The achromatic color correction block 221 includes a 1-D LUT and receives achromatic color grayscale data CLS_D to create corrected achromatic grayscale data CLS_D'. The 1-D LUT may have an identical format to that shown in Table 1 according to the first exemplary embodiment, so that the achromatic color grayscale data CLS_D are corrected to make the corrected achromatic color grayscale data CLS_D'. The achromatic color grayscale data CLS_D, in which all of red, green, and blue grayscale data RD2, GD2, and BD2 are identical to a value of z, may be corrected to the corrected achromatic color grayscale data CLS_D' having a z' value through the 1-D LUT. The chromatic color correction block 222 corrects chromatic color gray scale data CL_D to make corrected chromatic color grayscale data CL_D' through a 3-D interpolation scheme by taking the z' value into consideration.

In other words, according to the second exemplary embodiment of the present invention, the achromatic color correction block 221 and the chromatic color correction block 222 are arranged in series.

Accordingly, the grayscale data RD2, GD2, and BD2 provided from the gamma converter 110 may be corrected in the chromatic color correction block 222 after being corrected in the achromatic color correction block 221.

The division correction block 223 receives the corrected achromatic color grayscale data CLS_D' and the corrected chromatic color grayscale data CL_D' from the chromatic color correction block 222. The division correction block 223 divides the corrected achromatic color grayscale data CLS_D' and the corrected chromatic color grayscale data CL_D' to output the red, green, and blue driving signals RD3, GD3, and BD3. In addition, each of the red, green, and blue driving signals RD3, GD3, and BD3 may include first division grayscale data and second division grayscale data having a grayscale value less than or equal to a grayscale value of the first division grayscale data. In the present exemplary embodiment, the first division grayscale data may correspond to the first voltage applied to the first sub pixel electrode PE1 of each pixel, and the gray division grayscale data may correspond to the second voltage applied to the second sub pixel electrode PE2 of each pixel.

FIG. 6, FIG. 7, FIG. 8, FIG. 9, and FIG. 10 are views schematically showing the correction of grayscale data in the chromatic color correction block 222 through the 3-D interpolation scheme according to the second exemplary embodiment of the present invention.

Figure 6:
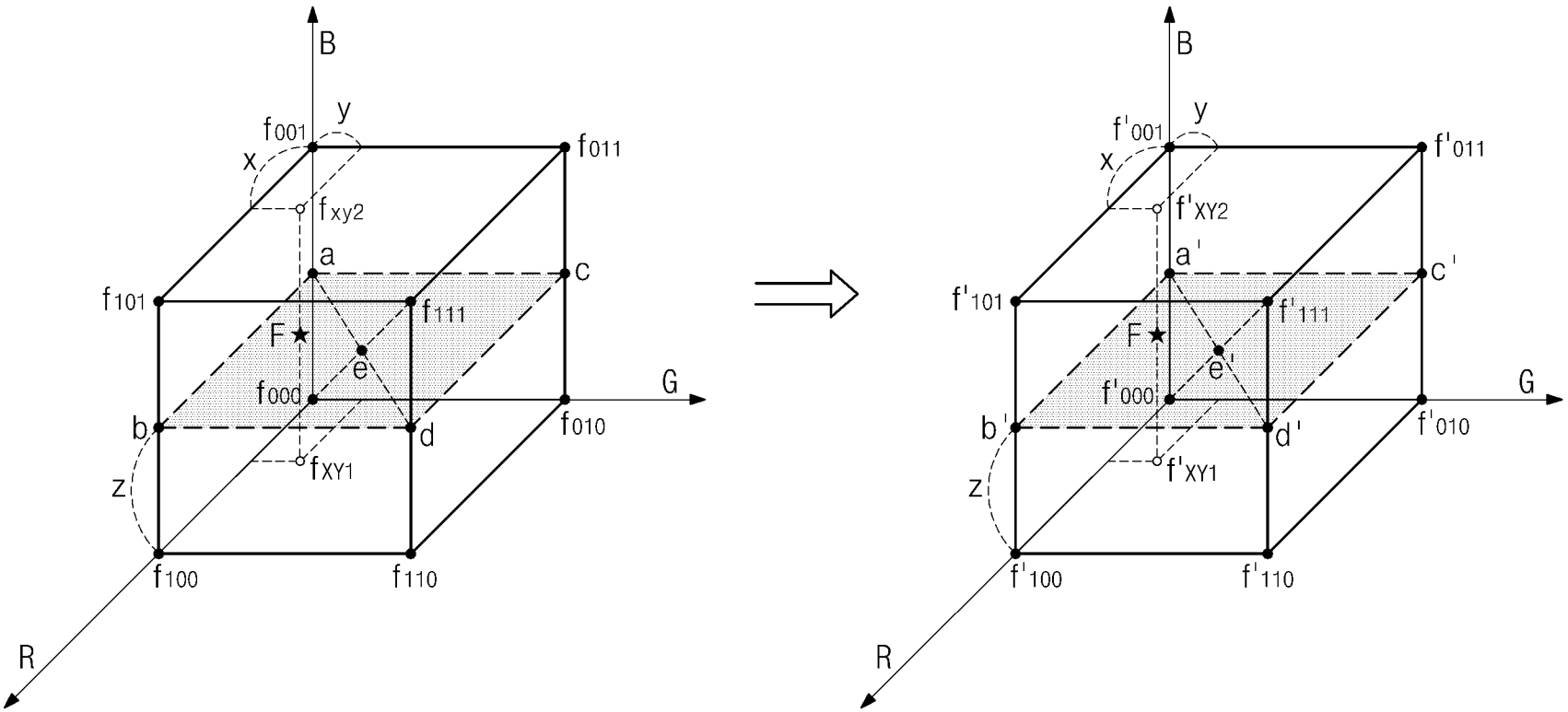
FIG. 6 is a view showing coordinates set by three axes of red grayscale data, green grayscale data, and blue grayscale data, respectively, and are perpendicular to each other in order to explain a 3-D interpolation scheme according to the second exemplary embodiment of the present invention.

FIG. 6 is a view showing parameters used in the 3-D interpolation scheme according to the second exemplary embodiment of the present invention. As shown in FIG. 6, $f_{000}$, $f_{001}$, $f_{010}$, $f_{011}$, $f_{100}$, $f_{101}$, $f_{110}$, and $f_{111}$ represent grayscale values of the 8 neighboring pixels which serve as reference and surround a grayscale value F to be corrected. The grayscale values of 8 neighboring pixels surrounding the grayscale value F are corrected values according to the first exemplary embodiment.

In this case, on the assumption that values, x, y, and z are distances between a grayscale value to be corrected and one among grayscale values of the 8 neighboring pixels, which serve as reference and surround the grayscale value F to be corrected, on an RG plane, a GB plane, and a BR plane, if grayscale values of red, green, and blue pixels are 33, 35, and 38, the distances x, y, and z from the gray scale value F to one (e.g., $f_{000}$ representing (0, 0, 0)) among the grayscale values of the 8 neighboring pixels, which serve as reference and surround the grayscale value F are 32, 35, and 38. In addition, $f'_{000}$, $f'_{001}$, $f'_{010}$, $f'_{011}$, $f'_{100}$, $f'_{101}$, $f'_{110}$, and $f'_{111}$ represent corrected values of the grayscale values of 8 neighboring pixels, which serve as reference.

For example, as described above, if the x, y, and z values are 33, 35, and 38, $f_{000}$, $f_{001}$, $f_{010}$, $f_{011}$, $f_{100}$, $f_{101}$, $f_{110}$, and $f_{111}$ representing the grayscale values of 8 neighboring pixels, which serve as reference and surround the grayscale value F, are (0, 0, 0), (0, 0, 64), (0, 64, 0), (0, 64, 64), (64, 0, 0), (64, 0, 64), (64, 64, 0), and (64, 64, 64). In addition, $f'_{000}$, $f'_{001}$, $f'_{010}$, $f_{011}$, $f'_{100}$, $f'_{101}$, $f'_{110}$, and $f'_{111}$ represent corrected gray scales of (0, 0, 0), (0, 0, 64), (0, 64, 0), (0, 64, 64), (64, 0, 0), (64, 0, 64), (64, 64, 0), and (64, 64, 64).

According to the second exemplary embodiment of the present invention, a trilinear interpolation scheme is performed by using a parameter e. In more detail, the parameter e represents an achromatic color having a grayscale value identical to one of red, green, and blue grayscale values. For example, the parameter e represents an achromatic color (R=G=B=z) having a grayscale value identical to the value of z that is a blue grayscale value. A parameter e' may be a value obtained by correcting the parameter e through a 1-D LUT.

For example, the parameter e' is a value obtained by correcting an achromatic color having a grayscale value identical to a grayscale value of a blue pixel through the 1-D LUT. In other words, the parameter e' is a value obtained by performing white balancing with respect to an achromatic color having a grayscale value identical to one of red, green, and blue grayscale values through the 1-D LUT.

In order to perform an interpolation scheme using the parameter e, a plane parallel to one of an RG plane, a GB plane, and a BR plane is selected from among planes including the parameter e. Then, vertexes of the selected plane, which meet with a hexahedron employing $f_{000}$, $f_{001}$, $f_{010}$, $f_{011}$, $f_{100}$, $f_{101}$, $f_{110}$, and $f_{111}$ as vertexes thereof, are designated as parameters a, b, c, and d, and the selected plane is designated as a plane 'a-b-c-d' in a two dimension.

For example, of the plane 'a-b-c-d', when the selected plane is parallel to the GR plane, the parameter a corresponds to a point in which the selected plane meets with a blue grayscale axis. The parameter b corresponds to a point, which is not positioned on the blue grayscale axis, among vertexes in which the selected plane meets with the BR plane. The parameter c corresponds to a point, which is not positioned on the blue grayscale axis, among points in which the selected plane meets with the BG plane. The parameter d corresponds to one remaining point.

For example, when the parameter e represents an achromatic color having a grayscale value identical to a blue grayscale value, the parameters a, b, c, and d may be calculated using Equation 7.

$$a = f_{000} + (f_{001} - f_{000})\frac{z}{N}$$
$$b = f_{100} + (f_{101} - f_{100})\frac{z}{N}$$
$$c = f_{010} + (f_{011} - f_{010})\frac{z}{N}$$
$$d = f_{110} + (f_{111} - f_{110})\frac{z}{N}$$

Equation 7

In Equation 7, $f_{000}$ to $f_{111}$ represent color coordinates corresponding to grayscale values stored in the 3-D LUT while surrounding the external grayscale data in a color coordinate space including red, blue, and green grayscale axes, the z represents a distance between $f_{000}$ and a point corresponding to one of red, green, and blue grayscale data of the external grayscale data, and the N represents a distance from $f_{000}$ to $f_{001}$.

The N represents a sample grayscale interval according to the size of an LUT. For example, N may be 64 in the case of a 5×5×5 LUT.

In addition, points ab, ac, bd, and cd (see, for example, FIG. 7), which are apart from the vertexes a, b, c, and d by the distances x and y, may be obtained through Equation 8.

$$ab = a + (b - a)\frac{z}{N}$$
$$ac = a + (c - a)\frac{z}{N}$$
$$bd = b + (d - b)\frac{z}{N}$$
$$cd = c + (d - c)\frac{z}{N}$$

Equation 8

The plane a-b-c-d in a 2-D domain may be divided into four sub-domains, that is, a first sub-domain to a fourth sub-domain based on the parameter e.

FIG. 7, FIG. 8, FIG. 9, and FIG. 10 are views respectively showing the first to fourth sub-domains. When drawing a line parallel to each side of the plane a-b-c-d while including the parameter e, a point, at which the line meets with a side linking the vertex a with the vertex b, is designated as "ab", a point, at which the line meets with a side linking the vertex b with the vertex d, is designated as "bd", a point, at which the line meets with a side linking the vertex c with the vertex d, is designated as "cd", and a point, at which the line meets with a side linking the vertex a with the vertex c, is designated as "ac". In this case, the four sub-domains may be obtained. Specifically, the first sub-domain a-ab-ac-e may have the points a, ab, ac, and e as four vertexes thereof; the second sub-domain ab-b-e-bd may have the points ab, b, e, and bd as four vertexes thereof; the third sub-domain ac-e-c-cd may have the points ac, e, c, and cd as four vertexes thereof; and the fourth sub-domain e-bd-cd-d may have the points e, bd, cd, and d as four vertexes thereof.

Figure 7:
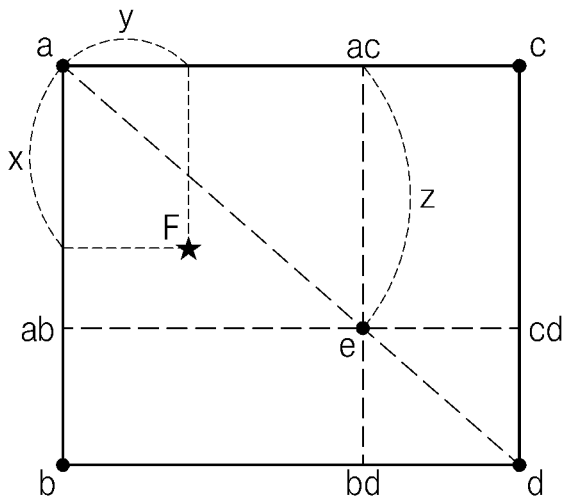
FIG. 7, FIG. 8, FIG. 9, and FIG. 10 are views respectively showing the first to fourth sub-domains.
Figure 8:
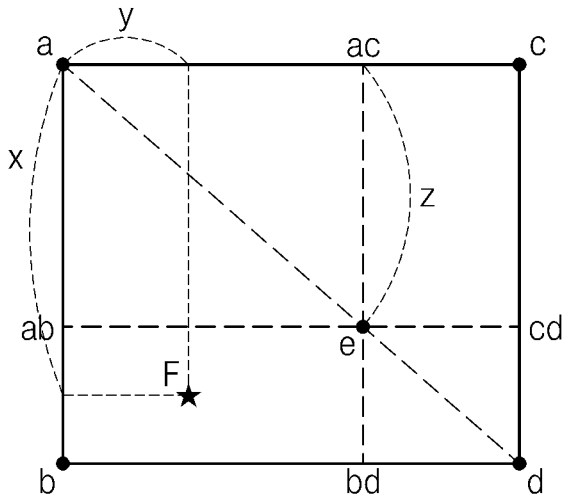
Figure 9:
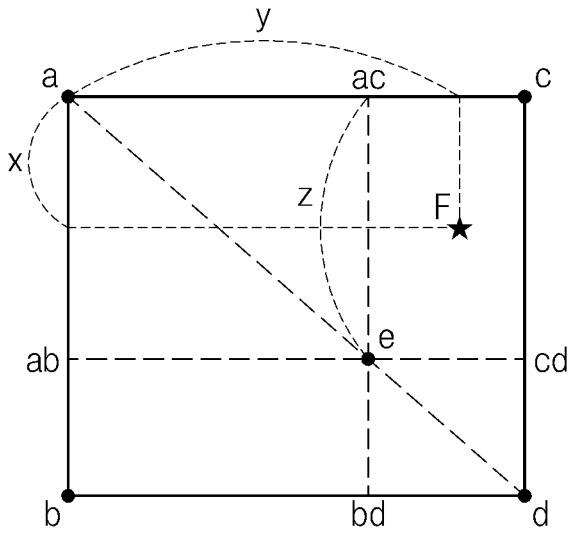
Figure 10:
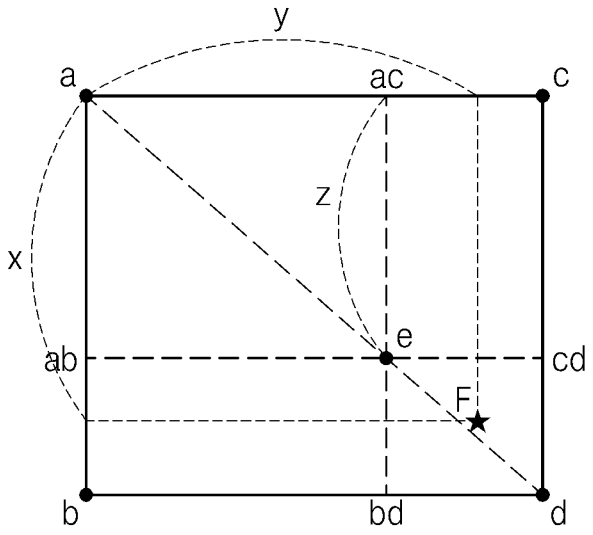

If a grayscale value F to be corrected is in case of x≤z and y≤z, it is positioned in the first sub-domain a-ab-ac-e (FIG. 7). If the grayscale value F to be corrected is in case of x≥z and y≤z, it is positioned in the second sub-domain ab-b-e-bd (FIG. 8). If the grayscale value F to be corrected is in case of x≤z and y≥z, it is positioned in the third sub-domain ac-e-c-cd (FIG. 9). If the grayscale value F to be corrected is in case of x≥z and y≥z, it is positioned in the fourth sub-domain e-bd-cd-d (FIG. 10).

The corrected grayscale value F' corresponding to the grayscale values to be corrected may be obtained through the following equations using the parameters.

Parameters a', b', c', and d' are corrected values for the parameters a, b, c, and d, and may be obtained through interpolation using Equation 9.

$$a' = f'_{000} + (f'_{001} - f'_{000})\frac{z}{N}$$
$$b' = f'_{100} + (f'_{101} - f'_{100})\frac{z}{N}$$
$$c' = f'_{010} + (f'_{011} - f'_{010})\frac{z}{N}$$
$$d' = f'_{110} + (f'_{111} - f'_{110})\frac{z}{N}$$

Equation 9

In Equation 9, the N represents a sample grayscale interval according to the size of an LUT. For example, N may be 64 in the case of a 5×5×5 LUT.

Corrected values a'b', a'c', b'd', and c'd' corresponding to the points ab, ac, bd, and cd may be obtained through Equation 10.

$$a'b' = a' + (b' - a')\frac{z}{N}$$
$$a'c' = a' + (c' - a')\frac{z}{N}$$
$$b'd' = b' + (d' - b')\frac{z}{N}$$
$$c'd' = c' + (d' - c')\frac{z}{N}$$

Equation 10

The corrected grayscale value F' can be calculated through Equations 9 to 12 for four sub-domains a'-a'b'-a'c'-e', a'b'-b'-e'-b'a', a'c'-e'-c'-c'd', and e'-b'd'-c'd'-d'branching from the sub-domain a'b'c'd' on the basis of the parameter e'.

Referring to FIG. 7, if a grayscale value F to be corrected is in case of x≤z and y≤z, the F' is positioned in the first sub-domain, and can be obtained through Equation 11.

$$\begin{aligned} F' &= a' + (a'b' - a')\frac{x}{z} + (a'c' - a')\frac{y}{z} + (a' + e' - a'b' - a'c')\frac{xy}{z^2} \\ &= a' + (b' - a')\frac{x}{N} + (c' - a')\frac{y}{N} + \left(e' - a' - (b' + c' - 2a')\frac{z}{N}\right)\frac{xy}{z^2} \end{aligned}$$

Equation 11

Referring to FIG. 8, if a grayscale value F to be corrected is in case of x≥z and y≤z, the corrected grayscale value F' is positioned in the second sub-domain, and can be obtained through Equation 12.

$$F' = a'b' + (b' - a'b')\frac{x - z}{N - z} + (e' - a'b')\frac{y}{z} +$$

Equation 12

-continued $$(a'b' + b'd' - b' - e')\frac{(x-z)y}{(N-z)z}$$
$$= a' + (b' - a')\frac{z}{N} + (b' - a')\left(1 - \frac{z}{N}\right)\frac{x-z}{N-z} +$$
$$\left((e' - a') - (b' - a')\frac{z}{N}\right)\frac{Y}{z} +$$
$$\left(a' - e' + (d' - a')\frac{z}{N}\right)\frac{(x-z)y}{(N-z)z}$$

Referring to FIG. 9, if the grayscale value F to be corrected is in case of x≤z and y≥z, the corrected grayscale value F' is positioned in the third sub-domain, and can be obtained through Equation 13.

$$F' = a'c' + (e' - a'c')\frac{x}{z} + (c' - a'c')\frac{y-z}{N-z} + (a'c' + c'd' - c' - e')\frac{(y-z)x}{(N-z)z} = a' + (c' - a')\frac{z}{N} + \left\{(e' - x') - \left(c' - a'\frac{z}{N}\right)\right\}\frac{x}{z} + (c' - a')\left(1 - \frac{z}{N}\right)\frac{y-z}{N-z} + \left\{a' - e' + (d' - a')\frac{z}{N}\right\}\frac{(y-z)x}{(N-z)z} \quad \text{Equation 13}$$

Referring to FIG. 10, if a grayscale value F to be corrected is in case of x≥z and y≥z, the corrected grayscale value F' is positioned in the fourth sub-domain, and can be obtained through Equation 14.

$$F' = a'c' + (e' - a'c')\frac{x}{z} + (c' - a'c')\frac{y-z}{N-z} + (a'c' + c'd' - c' - e')\frac{(y-z)x}{(N-z)z} = a' + (c' - a')\frac{z}{N} + \left\{(e' - x') - \left(c' - a'\frac{z}{N}\right)\right\}\frac{x}{z} + (c' - a')\left(1 - \frac{z}{N}\right)\frac{y-z}{N-z} + \left\{a' - e' + (d' - a')\frac{z}{N}\right\}\frac{(y-z)x}{(N-z)z} \quad \text{Equation 14}$$

The division correction block 223 divides the grayscale value F' corrected in the above manner according to unit pixels, for example, pixels A and B, and provides the corrected grayscale value to each pixel.

When correcting grayscale data according to the second exemplary embodiment, the discontinuity of brightness may be reduced in grayscale data approximate to achromatic grayscale data. In other words, according to the second exemplary embodiment, a grayscale difference between achromatic grayscale data (R=G=B) and chromatic grayscale data approximate to the achromatic grayscale data, which may occur when the achromatic grayscale data and grayscale data other than the achromatic grayscale data are separately corrected in parallel, can be reduced. Accordingly, the discontinuity of the brightness can be reduced between the achromatic grayscale data and the chromatic grayscale data approximate to the achromatic grayscale data.

When comparing with conventional ACC correction schemes such as a scheme of performing gamut mapping after transforming input color signals into signals having appropriate color coordinates on a color space, a scheme of performing a matrix operation after numerically expressing a mapping rule, and a scheme of using only an LUT to store mapped data, since an amount of computation in the correction scheme according to the first and second exemplary embodiments may be reduced, the correction scheme according to the first and second exemplary embodiments may be easily adapted in real time.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A signal processing apparatus, comprising:

a correction block to receive grayscale data comprising achromatic color grayscale data or chromatic color grayscale data and to create corrected grayscale data, wherein the correction block comprises:

a first correction block to receive the achromatic color grayscale data of the grayscale data and comprising a one-dimensional lookup table to create corrected achromatic color grayscale data based on the received achromatic color grayscale data, and a second correction block comprising a three-dimensional lookup table to store a portion of the chromatic color grayscale data, and an interpolator to correct, through an interpolation scheme, a remaining portion of the chromatic color grayscale data based on the corrected achromatic color grayscale data, the second correction block being configured to create corrected chromatic color grayscale data using the three-dimensional lookup table and the interpolator; and a division correction block to receive the corrected achromatic color grayscale data from the first correction block or to receive the corrected chromatic color grayscale data from the second correction block, the division correction block to divide the corrected achromatic color grayscale data or the corrected chromatic color grayscale data into red, green, and blue driving signals.

2. The signal processing apparatus of claim 1, wherein each of the achromatic color grayscale data and the chromatic color grayscale data comprises red, green, and blue grayscale data.

3. The signal processing apparatus of claim 2, wherein:

the achromatic color grayscale data comprise red, green, and blue grayscale data comprising the same grayscale value as each other; and the first correction block is configured to use the one-dimensional lookup table to create corrected red, green, and blue grayscale data based on the same grayscale value.

4. The signal processing apparatus of claim 3, wherein the second correction block is configured to reference the red, green, and blue grayscale data of the chromatic color grayscale data to create one of corrected red, green, and blue grayscale data of the corrected chromatic color grayscale data based on the three-dimensional lookup table.

5. The signal processing apparatus of claim 1, wherein the interpolation scheme is a trilinear interpolation scheme.

6. The signal processing apparatus of claim 1, wherein:

the grayscale data comprises at least one of red, green, and blue grayscale data; and the first correction block is configured to create the corrected achromatic color grayscale data based on one of the red, green, and blue grayscale data of the grayscale data.

7. The signal processing apparatus of claim 6, wherein:

the second correction block is configured to receive the corrected achromatic color grayscale data and the chromatic color grayscale data from the first correction block;

the interpolator is configured to utilize sub-domains formed by adjacent points among points "a", "b", "c", and "d", which are defined by Equation 1, a point "e" corresponding to the corrected achromatic color grayscale data, a point "ab" positioned on a line linking the point "a" with the point "b" while corresponding to the point "e", a point "ac" positioned on a line linking the point "a" with the point "c" while corresponding to the point "e", a point "cd" positioned on a line linking the point "c" with the point "d" while corresponding to the point "e", and a point "bd" positioned on a line linking the point "b" with the point "d" while corresponding to the point "e" in a first color coordinate space formed by red, blue, and green grayscale axes, and wherein the grayscale data are corrected through bilinear interpolation based on vertexes of a sub-domain comprising the grayscale data among the sub-domains, $$a = f_{000} + (f_{001} - f_{000})\frac{z}{N}$$
$$b = f_{100} + (f_{101} - f_{100})\frac{z}{N}$$
$$c = f_{010} + (f_{011} - f_{010})\frac{z}{N}$$
$$d = f_{110} + (f_{111} - f_{110})\frac{z}{N}$$

Equation 1 where $f_{000}$ to $f_{111}$ represent color coordinates corresponding to the chromatic color grayscale data stored in the three-dimensional lookup table while surrounding the grayscale data in the first color coordinate space comprising the red, blue, and green grayscale axes, the "z" represents a distance between $f_{000}$ and a point corresponding to one of the red, green, and blue grayscale data of the grayscale data, and the "N" represents a distance from $f_{000}$ to $f_{001}$.

8. The signal processing apparatus of claim 7, wherein the points "ab", "ac", "bd", and "cd" satisfy Equation 2, $$ab = a + (b - a)\frac{z}{N}$$
$$ac = a + (c - a)\frac{z}{N}$$
$$bd = b + (d - b)\frac{z}{N}$$
$$cd = c + (d - c)\frac{z}{N}.$$

Equation 2

9. The signal processing apparatus of claim 8, wherein the interpolator is configured to utilize sub-domains formed by adjacent points among points "a'", "b'", "c'", and "d'", which are defined by Equation 3, a point "e'" corresponding to the corrected achromatic color grayscale data, a point "ab'" positioned on a line linking the point "a'" with the point "b'" while corresponding to the point "e'", a point "a'c'" positioned on a line linking the point "a'" with the point "c'" while corresponding to the point "e'", a point "b'd'" positioned on a line linking the point "b'" with the point "d'" while corresponding to the point "e'", and a point "c'd'" positioned on a line linking the point "c'" with the point "d'" while corresponding to the point "e'", and wherein the grayscale data are corrected through bilinear interpolation based on vertexes of a sub-domain comprising the grayscale data among the sub-domains, $$a' = f'_{000} + (f'_{001} - f'_{000})\frac{z}{N}$$
$$b' = f'_{100} + (f'_{101} - f'_{100})\frac{z}{N}$$
$$c' = f'_{010} + (f'_{011} - f'_{010})\frac{z}{N}$$
$$d' = f'_{110} + (f'_{111} - f'_{110})\frac{z}{N}$$

Equation 3 where $f'_{000}$ to $f'_{111}$ represent color coordinates corresponding to grayscale values obtained by correcting $f_{000}$ to $f_{111}$ and stored in the three-dimensional lookup table, the "z" represents a distance between $f'_{000}$ and a point corresponding to one of the red, green, and blue grayscale data of the grayscale data, and the "N" represents a distance from $f'_{000}$ to $f'_{001}$.

10. The signal processing apparatus of claim 9, wherein the points "a'b'", "a'c'", "b'd'", and "c'd'" satisfy Equation 4, $$a'b' = a' + (b' - a')\frac{z}{N}$$
$$a'c' = a' + (c' - a')\frac{z}{N}$$
$$b'd' = b' + (d' - b')\frac{z}{N}$$
$$c'd' = c' + (d' - c')\frac{z}{N}.$$

Equation 4

11. The signal processing apparatus of claim 9, wherein a corrected grayscale data value F' in case of x≤z and y≤z is obtained through Equation 5, $$F' = a' + (a'b' - a')\frac{x}{z} + (a'c' - a')\frac{y}{z} + (a' + e' - a'b' - a'c')\frac{xy}{z^2}$$
$$= a' + (b' - a')\frac{x}{N} + (c' - a')\frac{y}{N} + \left(e' - a' - (b' + c' - 2a')\frac{z}{N}\right)\frac{xy}{z^2}$$

Equation 5 wherein the corrected grayscale data value F' in case of x≥z and y≤z is obtained through Equation 6, $$F' = a'b' + (b' - a'b')\frac{x - z}{N - z} + (e' - a'b')\frac{y}{z} + (a'b' + b'd' + b'd' - b' - e')\frac{(x - z)y}{(N - z)z}$$
$$= a' + (b' - a')\frac{z}{N} + (b' - a')\left(1 - \frac{z}{N}\right)\frac{x - z}{N - z} + \left((e' - a') - (b' - a') - \frac{z}{N}\right)\frac{Y}{z} +$$

Equation 6

-continued $$\left(a' - e' + (d' - a')\frac{z}{N}\right)\frac{(x-z)y}{(N-z)z}$$

wherein the corrected grayscale data value F' in case of x≤z and y≥z is obtained through Equation 7, $$\begin{aligned} F' &= a'c' + (e' - a'c')\frac{x}{z} + (c' - a'c')\frac{y-z}{N-z} + \\ &\quad (a'c' + c'd' - c' - e')\frac{(y-z)x}{(N-z)z} \\ &= a' + (c' - a')\frac{z}{N} + \left\{(e' - x') - \left(c' - a'\frac{z}{N}\right)\right\}\frac{x}{z} + \\ &\quad (c' - a')\left(1 - \frac{z}{N}\right)\frac{y-z}{N-z} + \\ &\quad \left\{a' - e' + (d' - a')\frac{z}{N}\right\}\frac{(y-z)x}{(N-z)z}, \end{aligned} \quad \text{Equation 7}$$

and wherein the corrected grayscale data value F' in case of x≥z and y≥z is obtained through Equation 8, $$\begin{aligned} F' &= a'c' + (e' - a'c')\frac{x}{z} + (c' - a'c')\frac{y-z}{N-z} + \\ &\quad (a'c' + c'd' - c' - e')\frac{(y-z)x}{(N-z)z} \\ &= a' + (c' - a')\frac{z}{N} + \left\{(e' - x') - \left(c' - a'\frac{z}{N}\right)\right\}\frac{x}{z} + \\ &\quad (c' - a')\left(1 - \frac{z}{N}\right)\frac{y-z}{N-z} + \\ &\quad \left\{a' - e' + (d' - a')\frac{z}{N}\right\}\frac{(y-z)x}{(N-z)z}, \end{aligned} \quad \text{Equation 8}$$

wherein the x and y represent distances from $f_{000}$ to points, which correspond to two remaining grayscale data other than one of the red, green, and blue grayscale data of the grayscale data, respectively.

12. A display apparatus comprising: pixels configured to receive at least two gate signals; and the signal processing apparatus of claim 1.

13. A signal processing method, comprising:

receiving grayscale data;

determining if the grayscale data are achromatic color grayscale data or chromatic color grayscale data;

creating corrected achromatic color grayscale data using a one-dimensional lookup table if the grayscale data are the achromatic color grayscale data;

creating corrected chromatic color grayscale data using a three-dimensional lookup table storing a portion of the chromatic color grayscale data, and using an interpolator to correct a remaining portion of the chromatic color grayscale data based on an interpolation scheme, if the grayscale data are the chromatic color gray scale data; and receiving the corrected achromatic color grayscale data or the corrected chromatic color grayscale data to divide the corrected achromatic color grayscale data or the corrected chromatic color grayscale data into red, green, and blue driving signals.

14. The signal processing method of claim 13, wherein each of the achromatic color grayscale data and the chromatic color grayscale data comprises red, green, and blue grayscale data.

15. The signal processing method of claim 14, wherein:

the achromatic color grayscale data comprise red, green, and blue grayscale data comprising an identical grayscale data as each other; and the one-dimensional lookup table is used to create corrected red, green, and blue grayscale data based on the identical grayscale data.

16. The signal processing method of claim 15, wherein the red, green, and blue grayscale data of the chromatic color grayscale data are referenced when creating one of the corrected red, green, and blue grayscale data of the corrected chromatic color grayscale data based on the three-dimensional lookup table.

17. A signal processing method, comprising:

receiving grayscale data comprising at least red, green, and blue grayscale data;

creating achromatic color grayscale data based on one of the red, green, and blue grayscale data of the received grayscale data;

creating corrected achromatic color grayscale data using a one-dimensional lookup table based on the achromatic color grayscale data;

creating corrected chromatic color grayscale data using a three-dimensional lookup table storing a portion of the chromatic color grayscale data, and an interpolator to correct, based on an interpolation scheme, a remaining portion of the chromatic color grayscale data by considering the corrected achromatic color grayscale data; and receiving the corrected achromatic color grayscale data or the corrected chromatic color grayscale data to divide the corrected achromatic color grayscale data or the corrected chromatic color grayscale data into red, green, and blue driving signals, wherein, in the creating of the corrected chromatic color grayscale data, the interpolator utilizes sub-domains formed by adjacent points among points "a", "b", "c", and "d", which are defined by Equation 1, a point "e" corresponding to the corrected achromatic color grayscale data, a point "ab" positioned on a line linking the point "a" with the point "b" while corresponding to the point "e", a point "ac" positioned on a line linking the point "a" with the point "c" while corresponding to the point "e", a point "bd" positioned on a line linking the point "b" with the point "d" while corresponding to the point "e"-, and a point "cd" positioned on a line linking the point "c" with the point "d" while corresponding to the point "e" in a first color coordinate space formed by red, blue, and green grayscale axes, and wherein the grayscale data are corrected through bilinear interpolation based on vertexes of a sub-domain comprising the grayscale data among the sub-domains, $$\begin{aligned} a &= f_{000} + (f_{001} - f_{000})\frac{z}{N} \\ b &= f_{100} + (f_{101} - f_{100})\frac{z}{N} \\ c &= f_{010} + (f_{011} - f_{010})\frac{z}{N} \\ d &= f_{110} + (f_{111} - f_{110})\frac{z}{N} \end{aligned} \quad \text{Equation 1}$$

where $f_{000}$ to $f_{111}$ represent color coordinates corresponding to the chromatic color grayscale data stored in the three-dimensional lookup table while surrounding the grayscale data in the first color coordinate space comprising the red, blue, and green grayscale axes, the "z"

represents a distance between $f_{000}$ and a point corresponding to one of the red, green, and blue grayscale data of the grayscale data, and the "N" represents a distance from $f_{000}$ to $f_{001}$.

18. The signal processing method of claim 17, wherein the points "ab", "ac", "bd", and "cd" satisfy Equation 2, $$ab = a + (b - a)\frac{z}{N}$$
$$ac = a + (c - a)\frac{z}{N}$$
$$bd = b + (d - b)\frac{z}{N}$$
$$cd = c + (d - c)\frac{z}{N}. \quad \text{Equation 2}$$

19. The signal processing method of claim 18, wherein the interpolator utilizes sub-domains formed by adjacent points among points "a'", "b'", "c'", and "d'", which are defined by Equation 3, a point "e'" corresponding to the corrected achromatic color grayscale data, a point "a'b'" positioned on a line linking the point "a'" with the point "b'" while corresponding to the point "e'", a point "a'c'" positioned on a line linking the point "a'" with the point "c'" while corresponding to the point "e'", a point "b'd'" positioned on a line linking the point "b'" with the point "d'" while corresponding to the point "e'", and a point "c'd'" positioned on a line linking the point "c'" with the point "d'" while corresponding to the point "e'", and wherein the grayscale data are corrected through bilinear interpolation based on vertexes of a sub-domain comprising the grayscale data among the sub-domains, $$a' = f'_{000} + (f'_{001} - f'_{000})\frac{z}{N}$$
$$b' = f'_{100} + (f'_{101} - f'_{100})\frac{z}{N}$$
$$c' = f'_{010} + (f'_{011} - f'_{010})\frac{z}{N}$$
$$d' = f'_{110} + (f'_{111} - f'_{110})\frac{z}{N} \quad \text{Equation 3}$$

where $f'_{000}$ to $f'_{111}$ represent color coordinates corresponding to grayscale values obtained by correcting $f_{000}$ to $f_{111}$ and stored in the three-dimensional lookup table, the "z" represents a distance between $f'_{000}$ and a point corresponding to one of the red, green, and blue grayscale data of the grayscale data, and the "N" represents a distance from $f'_{000}$ to $f'_{001}$.

20. The signal processing method of claim 19, wherein the points "a'b'", "a'c'", "b'd'", and "c'd'" satisfy Equation 4, $$a'b' = a' + (b' - a')\frac{z}{N}$$
$$a'c' = a' + (c' - a')\frac{z}{N}$$
$$b'd' = b' + (d' - b')\frac{z}{N}$$
$$c'd' = c' + (d' - c')\frac{z}{N}. \quad \text{Equation 4}$$

21. The signal processing method of claim 20, wherein a corrected grayscale data value F' in case of x≤z and y≤z is obtained through Equation 5, $$\begin{aligned} F' &= a' + (a'b' - a')\frac{x}{z} + (a'c' - a')\frac{y}{z} + (a' + e' - a'b' - a'c')\frac{xy}{z^2} \\ &= a' + (b' - a')\frac{x}{N} + (c' - a')\frac{y}{N} + \left(e' - a' - (b' + c' - 2a')\frac{z}{N}\right)\frac{xy}{z^2} \end{aligned} \quad \text{Equation 5}$$

wherein the corrected grayscale data value F' in case of x≥z and y≤z is obtained through Equation 6, $$\begin{aligned} F' &= a'b' + (b' - a'b')\frac{x - z}{N - z} + (e' - a'b')\frac{y}{z} + (a'b' + b'd' + b'd' - b' - e')\frac{(x - z)y}{(N - z)z} \\ &= a' + (b' - a')\frac{z}{N} + (b' - a')\left(1 - \frac{z}{N}\right)\frac{x - z}{N - z} + \left((e' - a') - (b' - a') - \frac{z}{N}\right)\frac{Y}{z} + \left(a' - e' + (d' - a')\frac{z}{N}\right)\frac{(x - z)y}{(N - z)z} \end{aligned} \quad \text{Equation 6}$$

wherein the corrected grayscale data value F' in case of x≤z and y≥z is obtained through Equation 7, $$\begin{aligned} F' &= a'c' + (e' - a'c')\frac{x}{z} + (c' - a'c')\frac{y - z}{N - z} + (a'c' + c'd' - c' - e')\frac{(y - z)x}{(N - z)z} \\ &= a' + (c' - a')\frac{z}{N} + \left\{(e' - x') - \left(c' - a'\frac{z}{N}\right)\right\}\frac{x}{z} + (c' - a')\left(1 - \frac{z}{N}\right)\frac{y - z}{N - z} + \left\{a' - e' + (d' - a')\frac{z}{N}\right\}\frac{(y - z)x}{(N - z)z}, \end{aligned} \quad \text{Equation 7}$$

and wherein the corrected grayscale data value F' in case of x≥z and y≥z is obtained through Equation 8, $$\begin{aligned} F' &= a'c' + (e' - a'c')\frac{x}{z} + (c' - a'c')\frac{y - z}{N - z} + (a'c' + c'd' - c' - e')\frac{(y - z)x}{(N - z)z} \\ &= a' + (c' - a')\frac{z}{N} + \left\{(e' - x') - \left(c' - a'\frac{z}{N}\right)\right\}\frac{x}{z} + (c' - a')\left(1 - \frac{z}{N}\right)\frac{y - z}{N - z} + \left\{a' - e' + (d' - a')\frac{z}{N}\right\}\frac{(y - z)x}{(N - z)z} \end{aligned} \quad \text{Equation 8}$$

wherein the x and y represent distances from $f_{000}$ to points, which correspond to two remaining grayscale data other than one of the red, green, and blue grayscale data of the grayscale data, respectively.

22. A signal processing apparatus, comprising:

a determination block to receive grayscale data and to determine if the grayscale data are achromatic color grayscale data or chromatic color grayscale data;

an achromatic color correction block to receive the achromatic color grayscale data from the determination block, the achromatic color correction block comprising a one-dimensional lookup table to create corrected achromatic color grayscale data;

a chromatic color correction block to receive the chromatic color grayscale data from the determination block, the chromatic color correction block comprising a three-dimensional lookup table to create corrected chromatic color grayscale data; and a division correction block to receive the corrected achromatic color grayscale data and the corrected chromatic color grayscale data and divide the corrected grayscale data according to unit pixels, and to provide a corrected gray scale value to each pixel, wherein the determination block is configured to provide the achromatic color grayscale data to the achromatic color correction block but not to the chromatic color correction block.

* * * * *